US012760490B1

(12) United States Patent
Stalp

(10) Patent No.: US 12,760,490 B1
(45) Date of Patent: Oct. 13, 2026

(54) CHAIN DRIVEN EXCAVATION WHEEL

(71) Applicant: Timothy L. Stalp, West Point, NE (US)

(72) Inventor: Timothy L. Stalp, West Point, NE (US)

( * ) Notice: Subject to any disclaimer, the term of this patent is extended or adjusted under 35 U.S.C. 154(b) by 338 days.

(21) Appl. No.: 18/379,983

(22) Filed: Oct. 13, 2023

Related U.S. Application Data

(60) Provisional application No. 63/416,137, filed on Oct. 14, 2022.

(51) Int. Cl.
*E02F 3/08* (2006.01)
*E02F 3/88* (2006.01)

(52) U.S. Cl.
CPC . *E02F 3/08* (2013.01); *E02F 3/88* (2013.01)

(58) Field of Classification Search
CPC ..... E02F 3/08–16
USPC ..... 37/347–380
See application file for complete search history.

(56) References Cited

U.S. PATENT DOCUMENTS 503,655 A 8/1893 Ellicott
744,703 A * 11/1903 Harris ..... E02F 3/9231 37/327
748,804 A 1/1904 Smythe et al.
1,028,387 A 6/1912 Roberson
1,492,817 A 5/1924 Martin
1,721,939 A 7/1929 Andersen
2,046,874 A * 7/1936 Hudson ..... E02F 3/50 37/447
2,828,557 A * 4/1958 Brown ..... E02F 3/10 37/363
2,896,341 A 7/1959 Ray
2,995,843 A * 8/1961 Hutchison ..... E02F 3/08 299/83.1
3,476,498 A * 11/1969 Bolhar ..... E02F 3/9237 37/189
3,525,167 A * 8/1970 French et al. ..... E02F 3/655 198/522
3,603,009 A 9/1971 Velzeboer
3,919,790 A 11/1975 Sasaki et al.
4,267,652 A 5/1981 Senesac
4,547,162 A 10/1985 Little
4,942,682 A 7/1990 McDowell
5,190,409 A * 3/1993 Hall ..... E02F 5/003 37/367

FOREIGN PATENT DOCUMENTS

EP 0114584 A2 8/1984
EP 0226660 B1 7/1989
EP 0532490 B1 3/1997
EP 2746463 A1 6/2014
GB 191326384 A 11/1914
(Continued)

*Primary Examiner* — Tara Mayo
(74) *Attorney, Agent, or Firm* — Suiter Swantz IP

(57) ABSTRACT

A dredging unit includes a chain-driven excavator wheel and a suction pipe. The excavator wheel defines one or more openings. The suction pipe suctions loose materials through the openings defined by the excavator wheel. The dredging unit also includes a drive with a sprocket that drives the chain and subsequently the excavator wheel. The suction pipe also suctions loose materials through the interface between the chain and the excavator wheels. A dredge pump is utilized for transport of the material.

20 Claims, 19 Drawing Sheets

(56) References Cited

FOREIGN PATENT DOCUMENTS

| | | | |
|---|---|---|---|
| GB | 772470 | A | 4/1957 |
| GB | 1428749 | A | 3/1976 |
| KR | 101012750 | B1 | 2/2011 |

* cited by examiner

100

CHAIN DRIVEN EXCAVATION WHEEL

CROSS-REFERENCE TO RELATED APPLICATIONS

The present application claims the benefit under 35 U.S.C. § 119(e) of U.S. Provisional Application Ser. No. 63/416,137, filed Oct. 14, 2022, titled "CHAIN DRIVEN EXCAVATION WHEEL", which is incorporated herein by reference in the entirety.

TECHNICAL FIELD

The present invention generally relates to dredging, and more particularly to hydraulic dredging using chain ladder dredgers.

BACKGROUND

Dredgers refer to equipment for dredging, excavating, loosening, or moving earth. Dredgers may move the earth by mechanical and/or hydraulic means (e.g., suction). Dredgers may be categorized as cutter basket rotary-style dredgers, chain ladder dredgers, bucket wheel dredgers, water jet and dust pan style dredgers, and the like.

Cutter basket rotary-style dredgers may include a drill bit for loosening slurry and keeping oversize from plugging a dredge pump. The cutter basket rotary-style dredgers may include the following disadvantages: (1) prone to nesting due to oversize material having nowhere to go but remain in the excavation area; (2) basket plugging due to rocks get stuck in oversize grating of basket; (3) ladder interference or ladder hang up; (4) no excavation behind ladder structure.

Bucket wheel dredgers may include one or more buckets. The buckets may be used to dredge material. The bucket wheel dredgers may also include a suction pipe upon the opposite side of the wheel. The bucket wheel dredgers may include the following disadvantages: (1) suction unit can plug due to rotational baskets that force material into suction area; (2) material can jam into, pack, or plug the basket causing reduced production; (3) difficult to screen oversize material due to nesting of rock that cannot be moved away from suction; (4) ladder interference due to no means of clearing material on underside of ladder.

Water jet and dust pan styles dredgers may inject water into the soil and use a dustpan suction head to suction loose material. The water jet and dust pan styles dredgers may include the following disadvantages: (1) limited to free-flowing materials; (2) low production due to no mechanical excavation; (3) pump is unable to handle oversize material; (4) if unit has an oversize screen, the screen is prone to plugging.

Chain ladder dredgers may include a chain that runs in front of a suction mouth. The chain may continue in a rotational circle from the drive on one end to the front suction area. The chain ladder dredgers may include the following disadvantages: (1) limited excavation due to very small profile of chain and small suction mouth areas; (2) no side suction so excavation is called slot dredging; (3) excavation is very limited due to a small profile chain sliding in front of the suction pipe; (4) production is lower without a rotating element to excavate. Therefore, it would be advantageous to provide a device that can cures the shortcomings described above.

SUMMARY

A dredging unit is described. The dredging units comprises a pair of beams. The dredging units comprises a drive coupled to a first end of the pair of beams. The drive comprises a first sprocket. The drive is configured to rotate the first sprocket. The dredging units comprises an excavation wheel rotatably coupled to a second end of the pair of beams. The excavation wheel comprises a pair of side plates. The pair of side plates each define a plurality of openings. The pair of side plates rotate with the excavation wheel as the excavation wheel rotates relative to the pair of beams. The excavation wheel comprises a second sprocket disposed between and coupled to the pair of side plates. The dredging unit comprises a chain coupled to the first sprocket and the second sprocket. Rotation of the first sprocket causes the chain to rotate causing the second sprocket to rotate the excavation wheel. The dredging units comprises a suction pipe. The suction pipe comprises a suction inlet. The suction inlet is disposed between the pair of beams at the second end of the pair of beams.

In some embodiments, the suction inlet is configured to suction a slurry through the plurality of openings defined by each of the pair of side plates and suction the slurry through an interface between the chain and the excavation wheel.

In some embodiments, the drive comprises a motor and a gearbox. The gearbox is coupled between the motor and the first sprocket.

In some embodiments, the motor is a hydraulic motor.

In some embodiments, the gearbox is a reduction gearbox.

In some embodiments, the chain comprises a plurality of links and a plurality of extractor elements. The plurality of extractor elements are coupled to the plurality of links.

In some embodiments, the dredging unit comprises a pair of shaft supports coupled to the pair of beams. The excavation wheel comprises a shaft coupled to the pair of side plates and to the pair of shaft supports.

In some embodiments, the dredging unit comprises a plurality of rollers. The plurality of rollers support the chain between the first end and the second end of the pair of beams.

In some embodiments, a first set of the plurality of rollers are coupled between the pair of beams.

In some embodiments, the dredging unit comprises a pair of trusses. The pair of trusses are coupled to the pair of beams. A second set of the plurality of rollers are coupled between the pair of trusses.

In some embodiments, the dredging unit comprises an idler coupled to the pair of beams. The idler tensions the chain.

In some embodiments, the plurality of openings comprises a plurality of circular openings.

In some embodiments, the pair of side plates are circular plates. The plurality of circular openings are arranged in a pattern on the pair of side plates.

A dredging system is described. The dredging system comprises a barge. The dredging system comprises a ladder pivotably mounted to the barge. The dredging system comprises a dredge pump. The dredging system comprises a dredging unit coupled to the ladder. The dredging unit comprises a pair of beams. The dredging unit comprises a drive coupled to a first end of the pair of beams. The drive comprises a first sprocket. The drive is configured to rotate the first sprocket. The dredging unit comprises an excavation wheel rotatably coupled to a second end of the pair of beams. The excavation wheel comprises a pair of side plates. The pair of side plates each define a plurality of openings. The pair of side plates rotate with the excavation wheel as the excavation wheel rotates relative to the pair of beams. The excavation wheel comprises a second sprocket disposed between and coupled to the pair of side plates. The dredging unit comprises a chain coupled to the first sprocket and the second sprocket. Rotation of the first sprocket causes the chain to rotate causing the second sprocket to rotate the excavation wheel. The dredging unit comprises a suction pipe comprising a suction inlet. The suction inlet is disposed between the pair of beams at the second end of the pair of beams. The dredge pump is fluidically coupled to the suction pipe.

In some embodiments, the dredge pump is coupled to the ladder.

In some embodiments, the dredging system comprises a power source and a drive shaft. The power source is coupled to the barge. The power source is coupled to the dredge pump by the drive shaft.

In some embodiments, the dredge pump is coupled to the barge.

In some embodiments, the barge defines a slot receiving the dredging unit and the ladder.

In some embodiments, the dredging system is positively buoyant in a fluid with a density of 1 gram per cubic centimeter.

In some embodiments, the dredging system comprises a winch mounted to the barge above the dredging unit. The winch is coupled to the at least one of the dredging unit or the ladder.

BRIEF DESCRIPTION OF THE DRAWINGS

The numerous advantages of the disclosure may be better understood by those skilled in the art by reference to the accompanying figures in which:

FIG. 1I depicts a top view of a dredging unit, in accordance with one or more embodiments of the present disclosure.

DETAILED DESCRIPTION OF THE INVENTION

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure. Reference will now be made in detail to the subject matter disclosed, which is illustrated in the accompanying drawings.

Embodiments of the present disclosure are directed to a dredging system including a dredging unit. The dredging unit includes a chain-driven excavator wheel and a suction pipe. The excavator wheel defines one or more openings. The suction pipe suctions loose materials through the openings defined by the excavator wheel. The dredging unit also includes a drive with a sprocket that drives the chain and subsequently the excavator wheel. The suction pipe also suctions loose materials through the interface between the chain and the excavator wheels (e.g., between links in the chain). A dredge pump is utilized for transport of the material.

U.S. Pat. No. 1,028,387, titled "Suction-dredger", filed on Jan. 3, 1910; U.S. Pat. No. 1,721,939, titled "Chain-equipped structure", filed on Oct. 27, 1927; U.S. Pat. No. 748,804, titled "Dredging-machine", granted on Jan. 5, 1904; U.S. Pat. No. 4,547,162, titled "Spud support for use in water of excessive depth", filed on Feb. 11, 1985; European Patent No. EP0114584, titled "Chain cutter excavator", filed on Dec. 27, 1983; European Patent No. EP0226660, titled "Digging bucket wheel device", filed on Dec. 24, 1985; United Kingdom Patent No. GB1428749A; titled "Drainage system", filed on Aug. 10, 1973; are each incorporated herein by reference in the entirety.

Figure 1A:
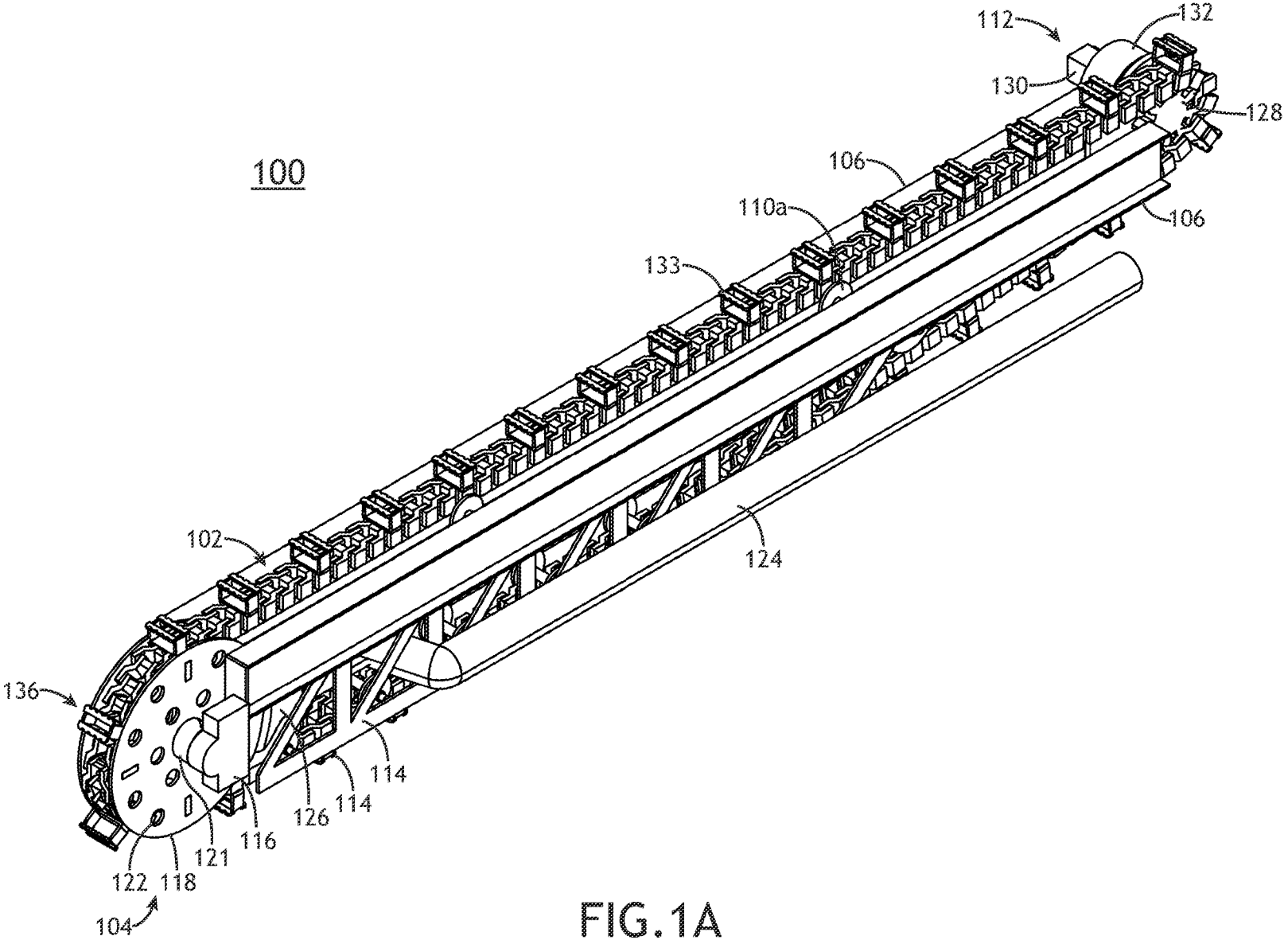
FIG. 1A depicts a right-front perspective view of a dredging unit, in accordance with one or more embodiments of the present disclosure.
Figure 1B:
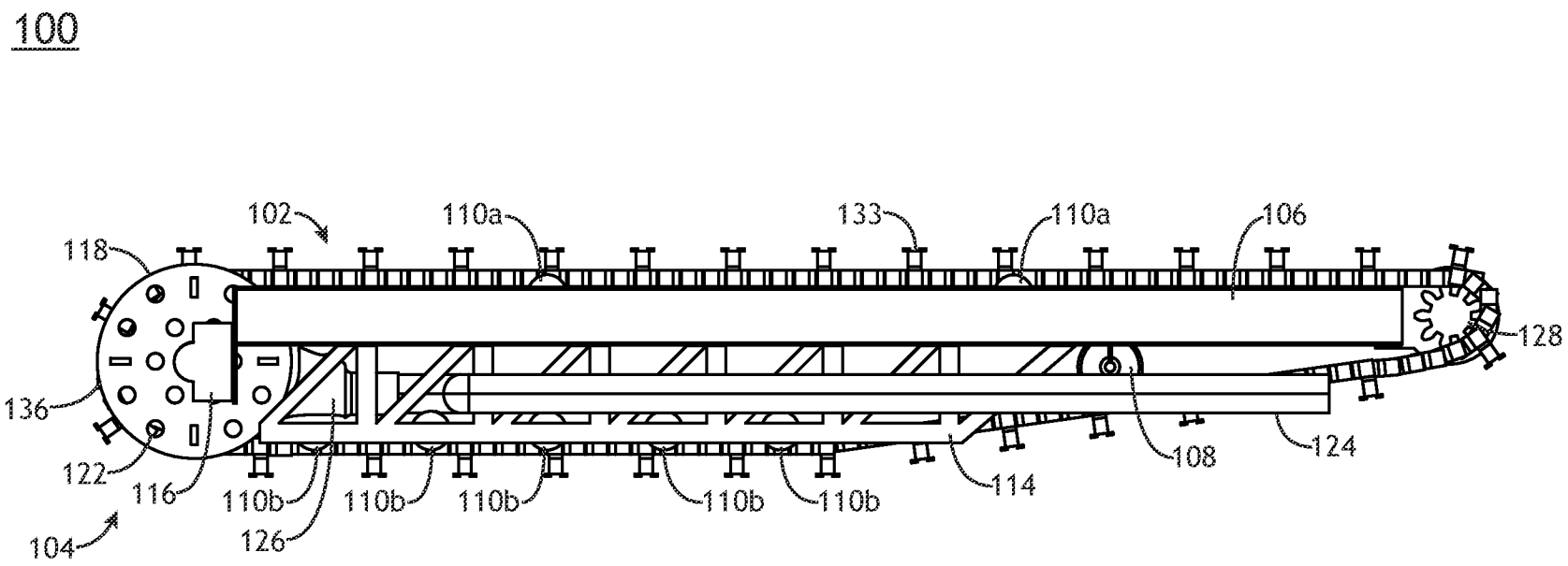
FIG. 1B depicts a right-side view of a dredging unit, in accordance with one or more embodiments of the present disclosure.
Figure 1C:
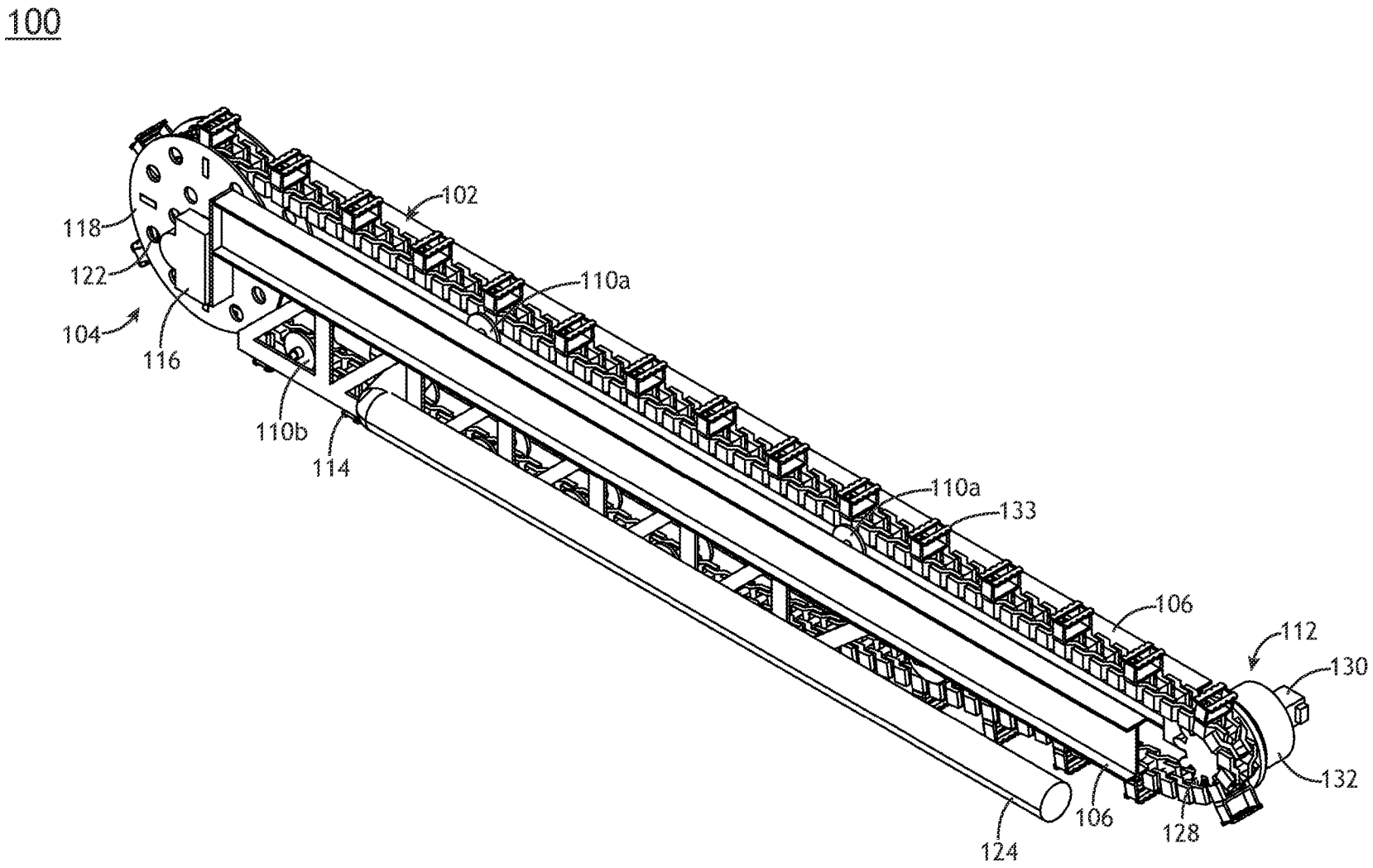
FIG. 1C depicts a right-rear perspective view of a dredging unit, in accordance with one or more embodiments of the present disclosure.
Figure 1D:
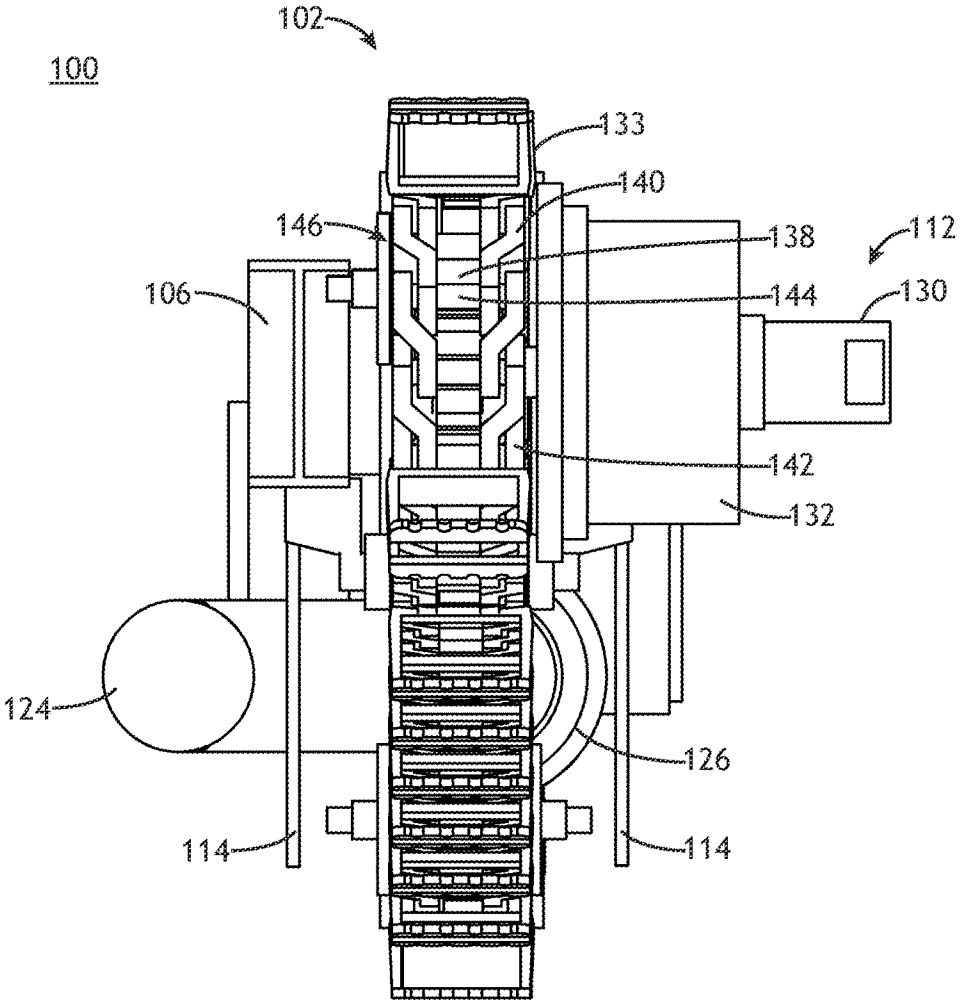
FIG. 1D depicts a rear view of a dredging unit, in accordance with one or more embodiments of the present disclosure.
Figure 1E:
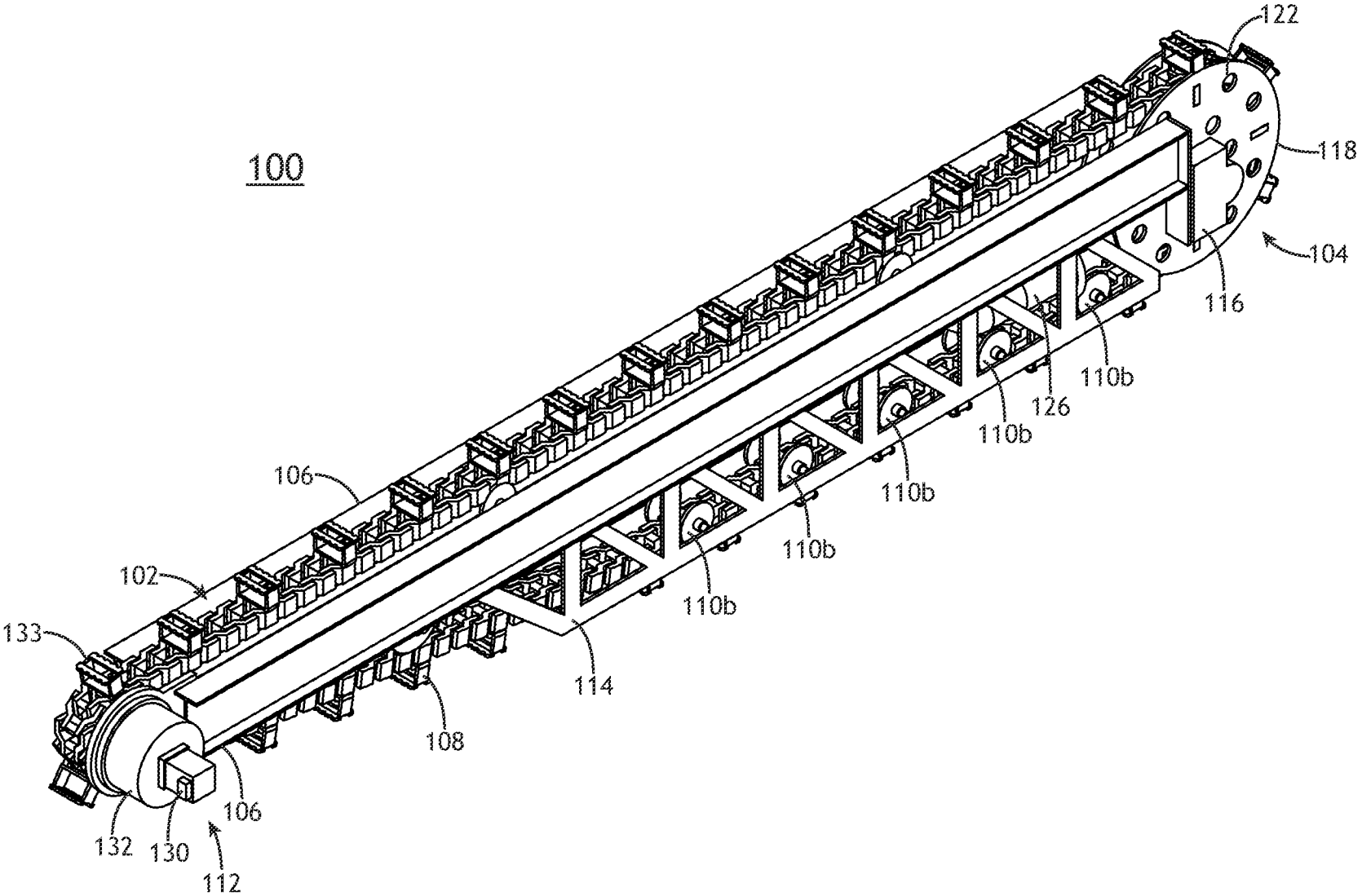
FIG. 1E depicts a left-rear perspective view of a dredging unit, in accordance with one or more embodiments of the present disclosure.
Figure 1F:
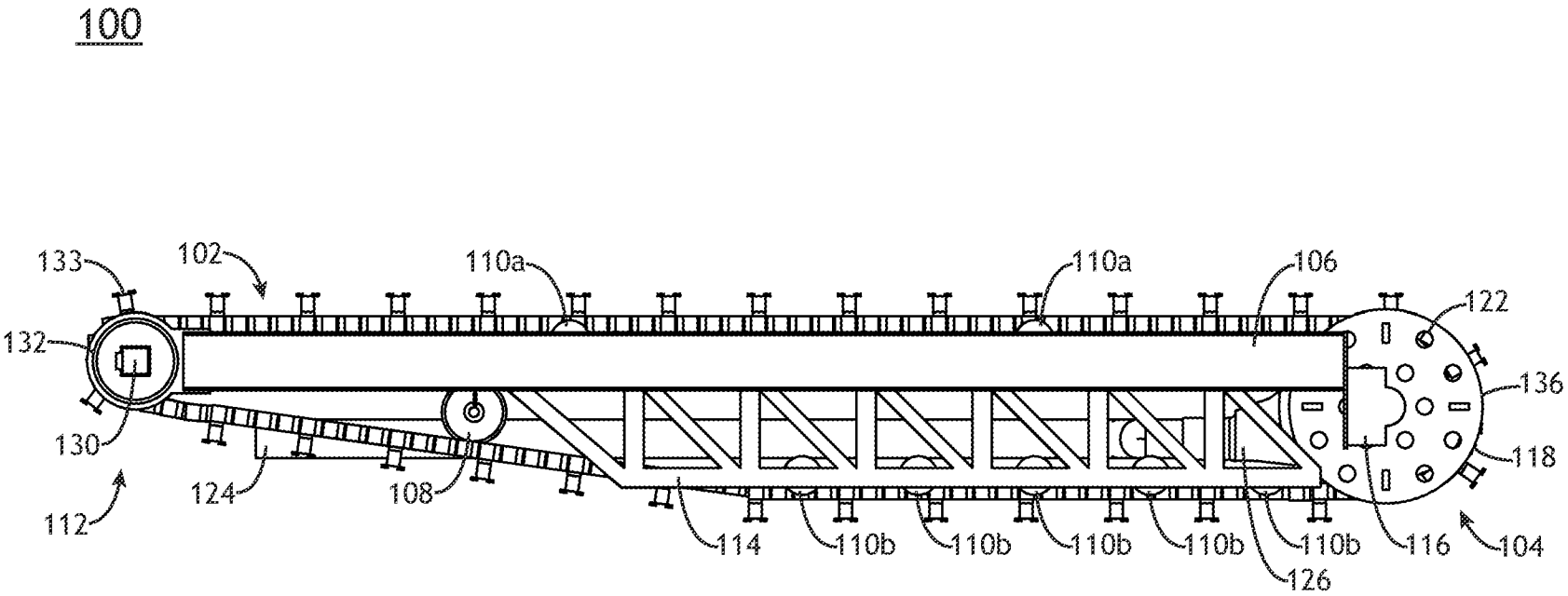
FIG. 1F depicts a left-side view of a dredging unit, in accordance with one or more embodiments of the present disclosure.
Figure 1G:
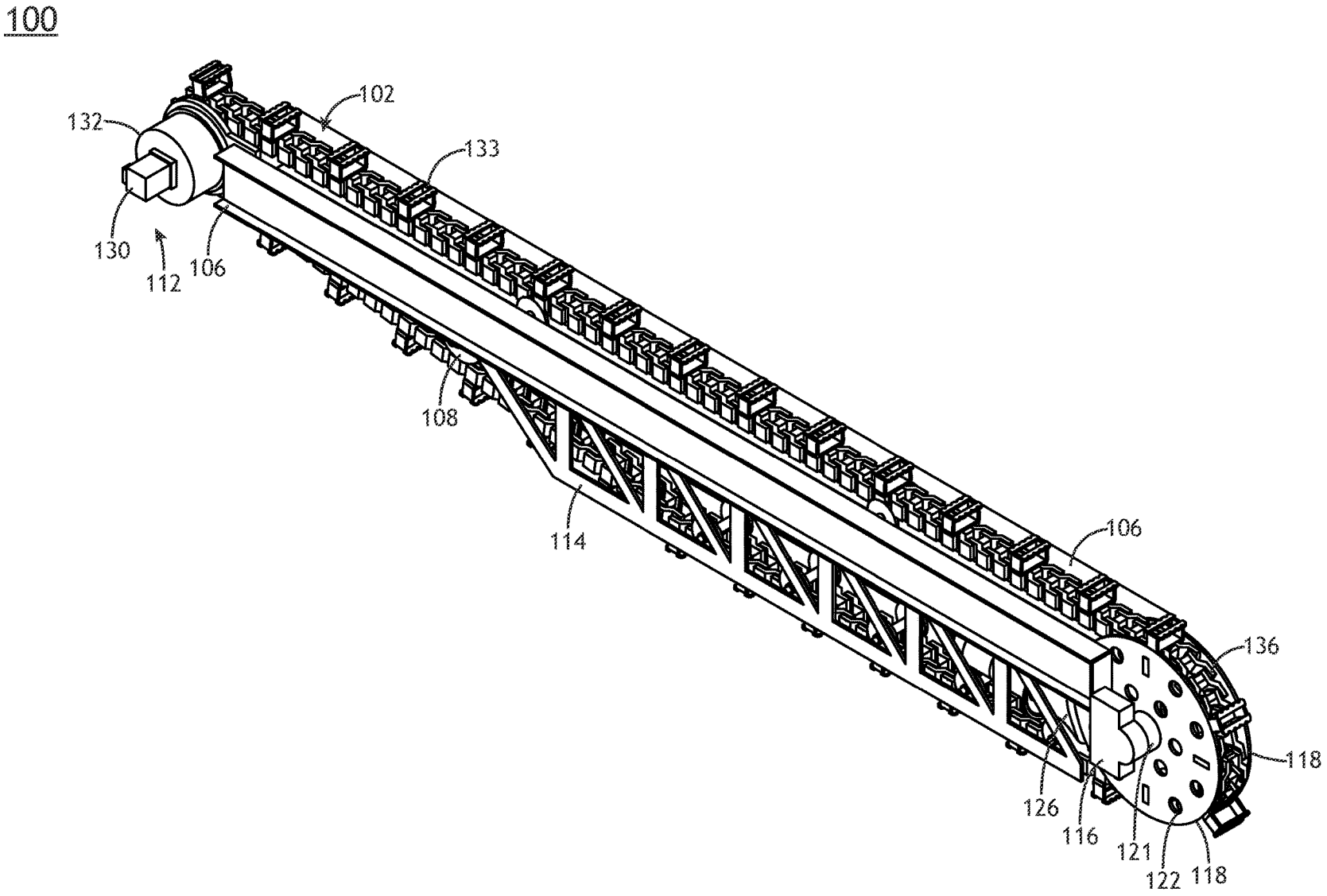
FIG. 1G depicts a left-front perspective view of a dredging unit, in accordance with one or more embodiments of the present disclosure.
Figure 1H:
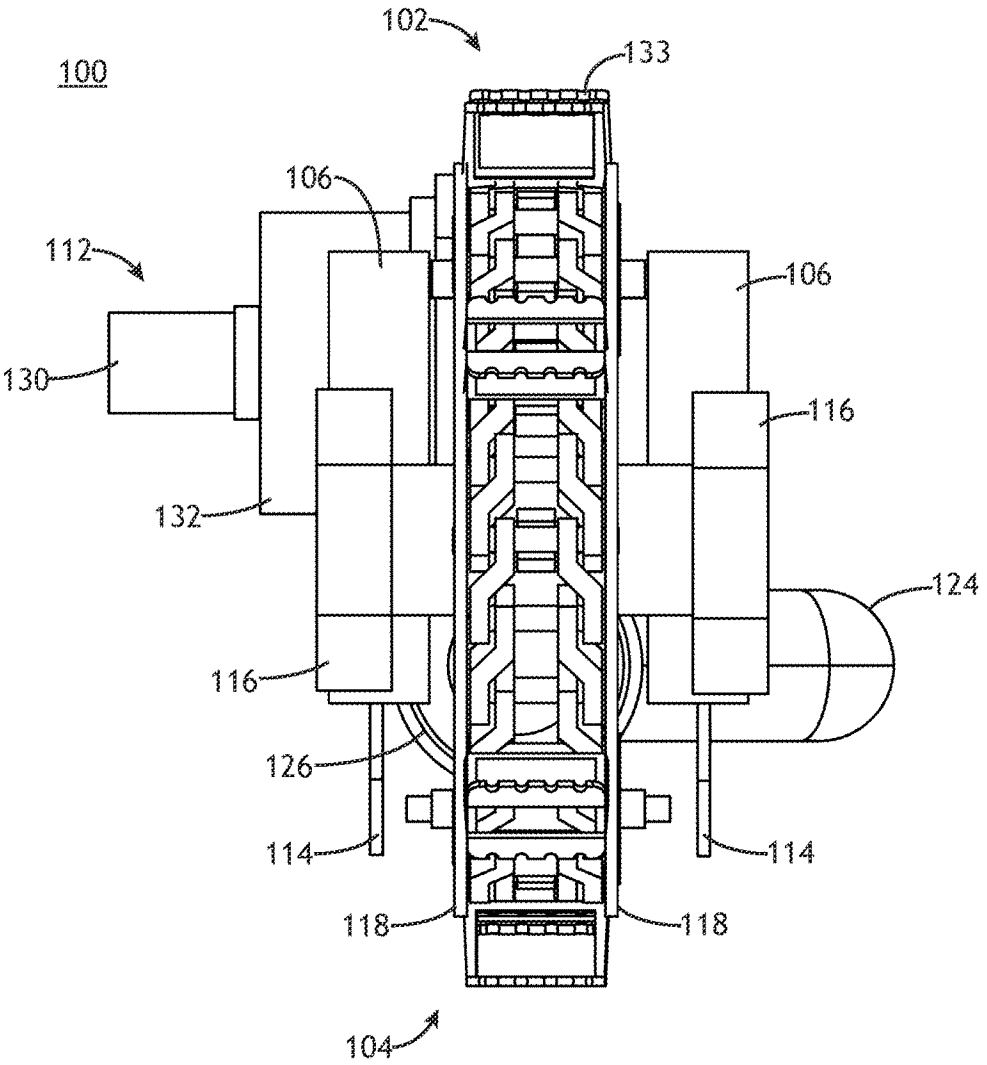
FIG. 1H depicts a front view of a dredging unit, in accordance with one or more embodiments of the present disclosure.
Figure 11:
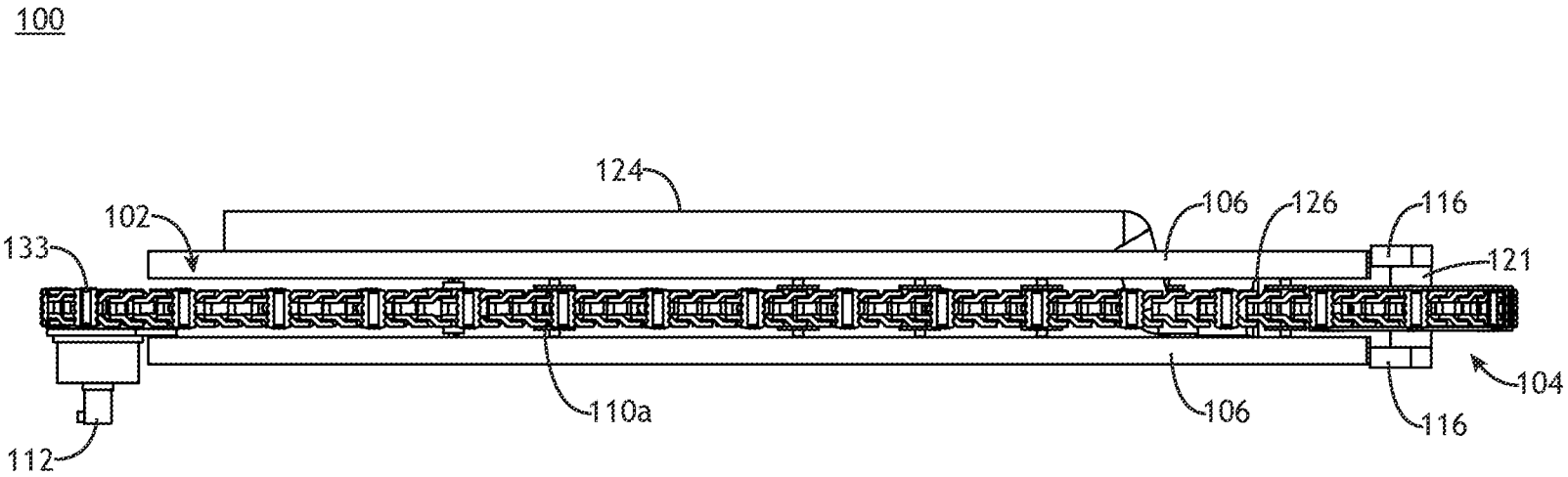
Figure 1J:
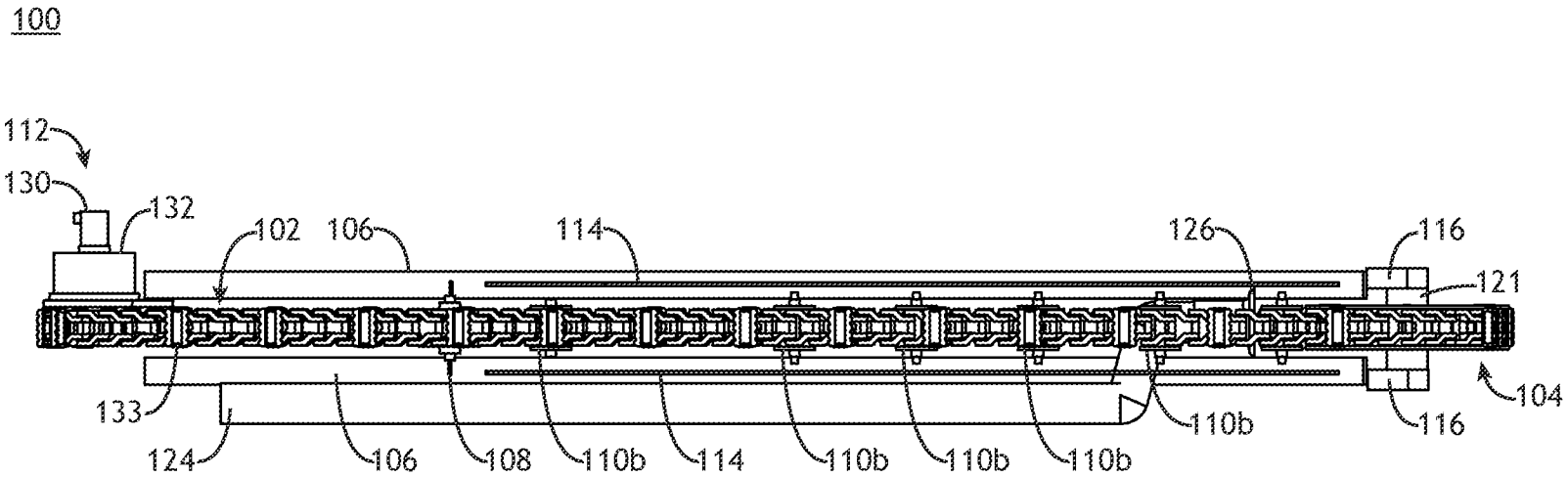
FIG. 1J depicts a bottom view of a dredging unit, in accordance with one or more embodiments of the present disclosure.
Figure 1K:
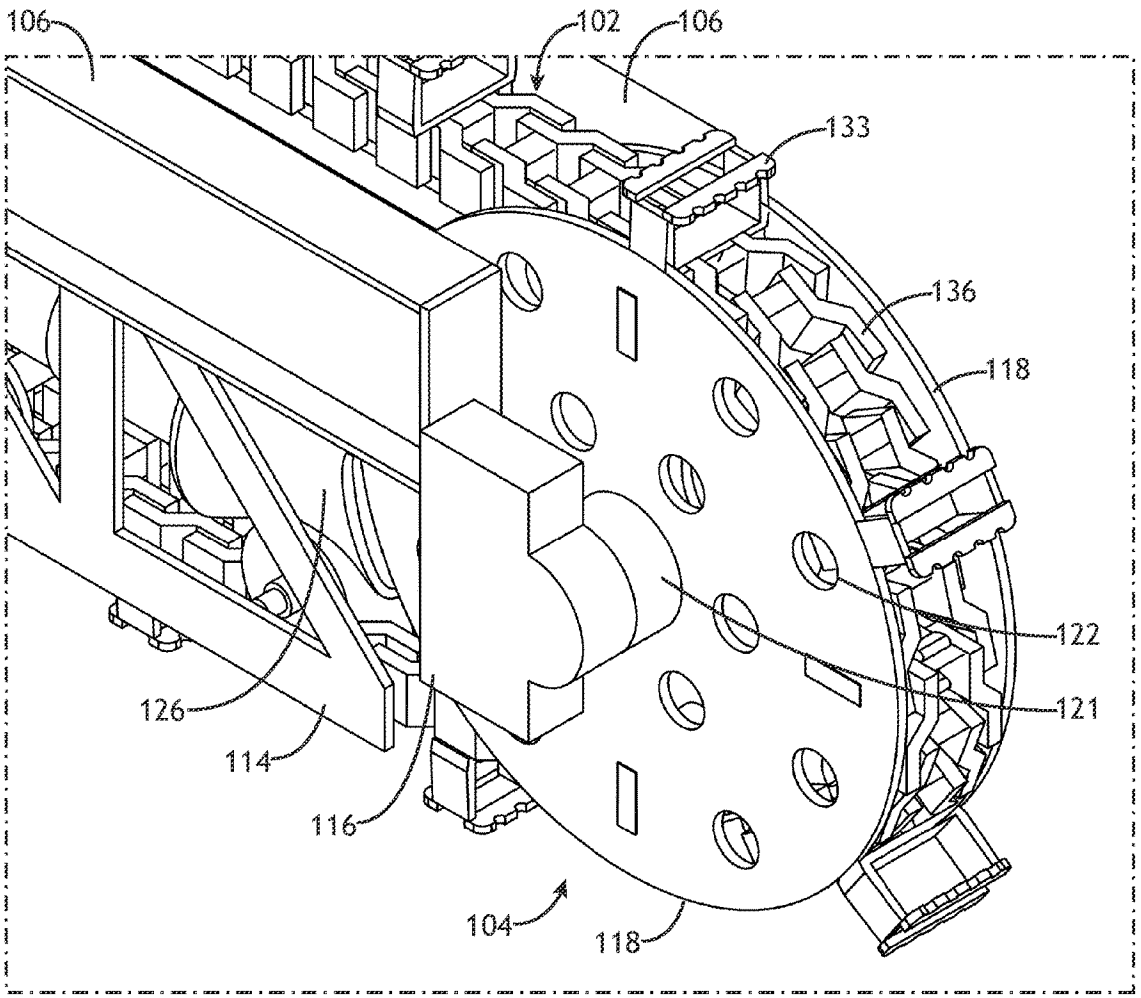
FIG. 1K depicts a partial left-front perspective view of a dredging unit, in accordance with one or more embodiments of the present disclosure.
Figure 1L:
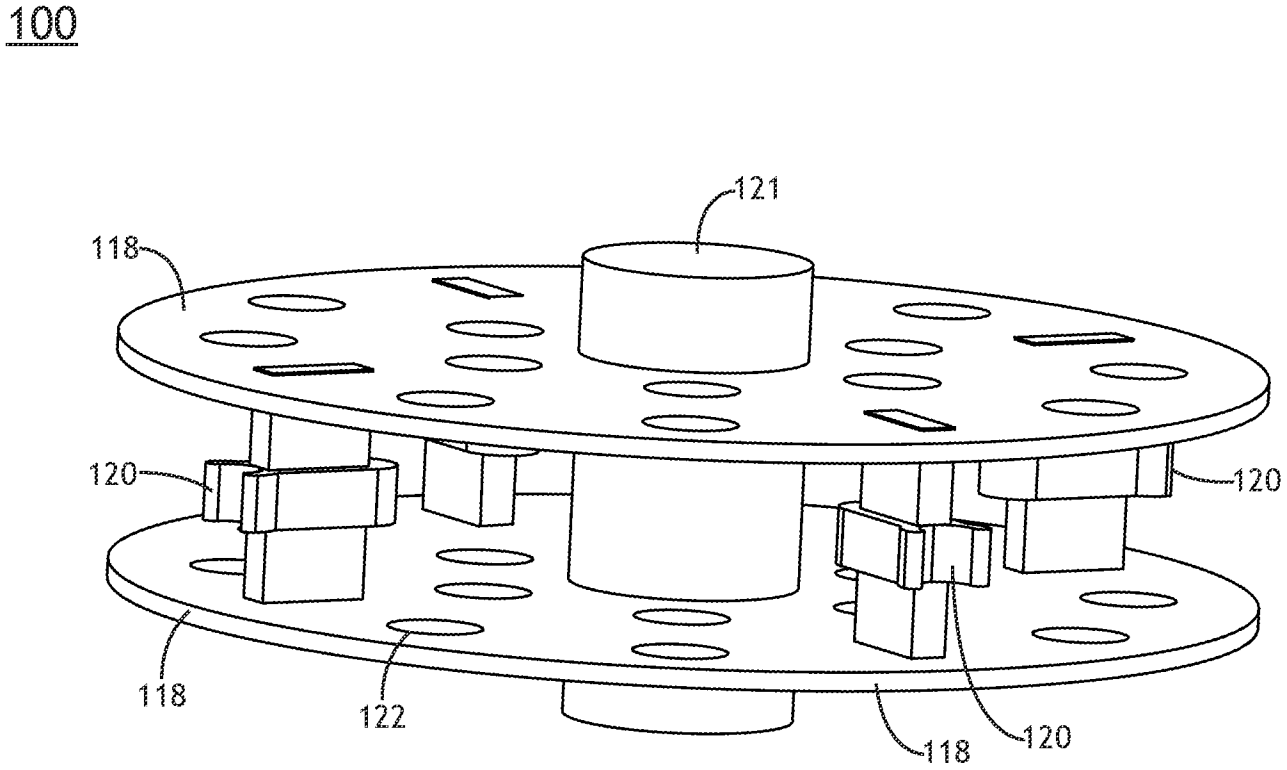
FIG. 1L depicts a perspective view of an excavation wheel, in accordance with one or more embodiments of the present disclosure.
Figure 1M:
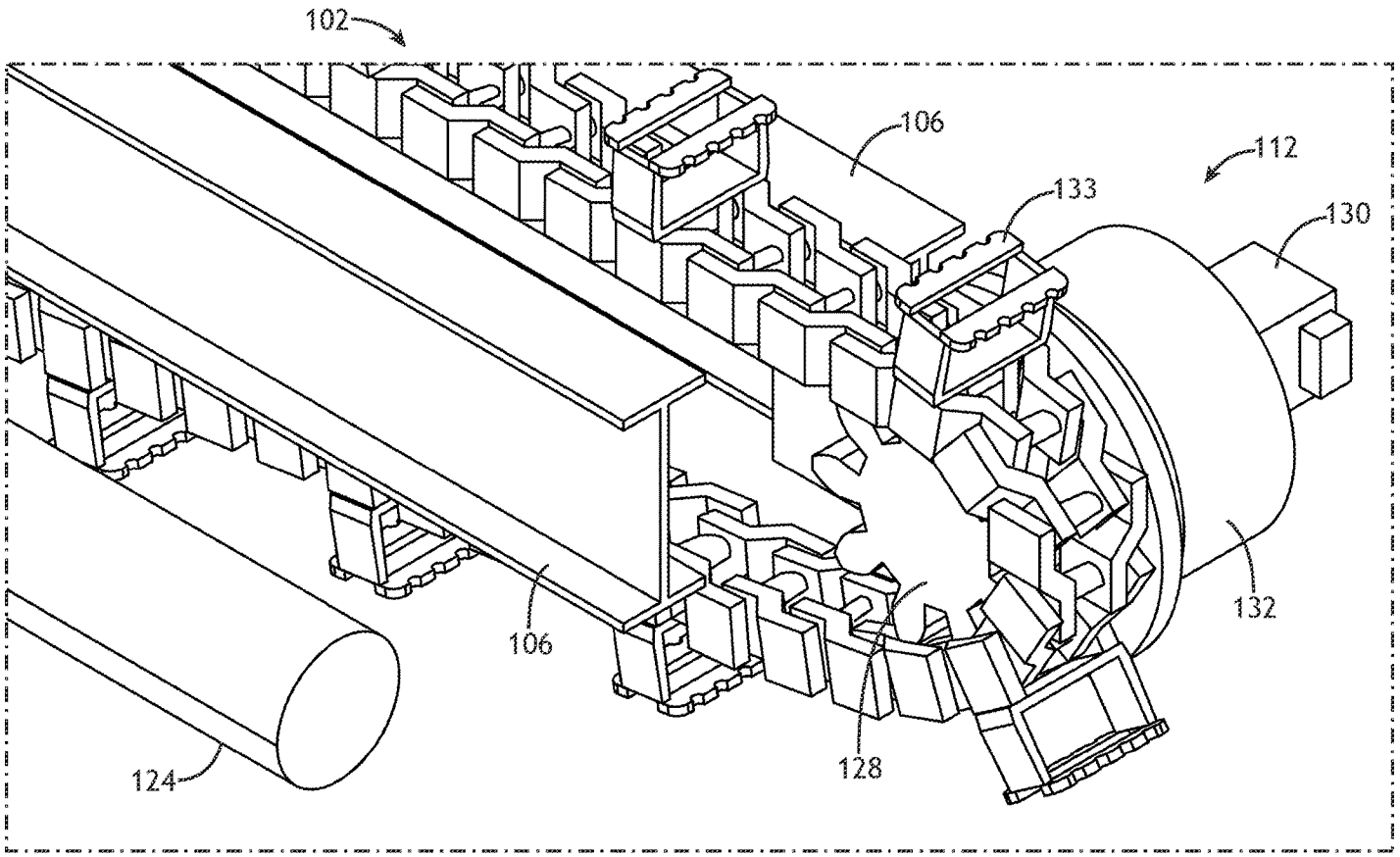
FIG. 1M depicts partial right-rear perspective view of a dredging unit, in accordance with one or more embodiments of the present disclosure.
Figure 1N:
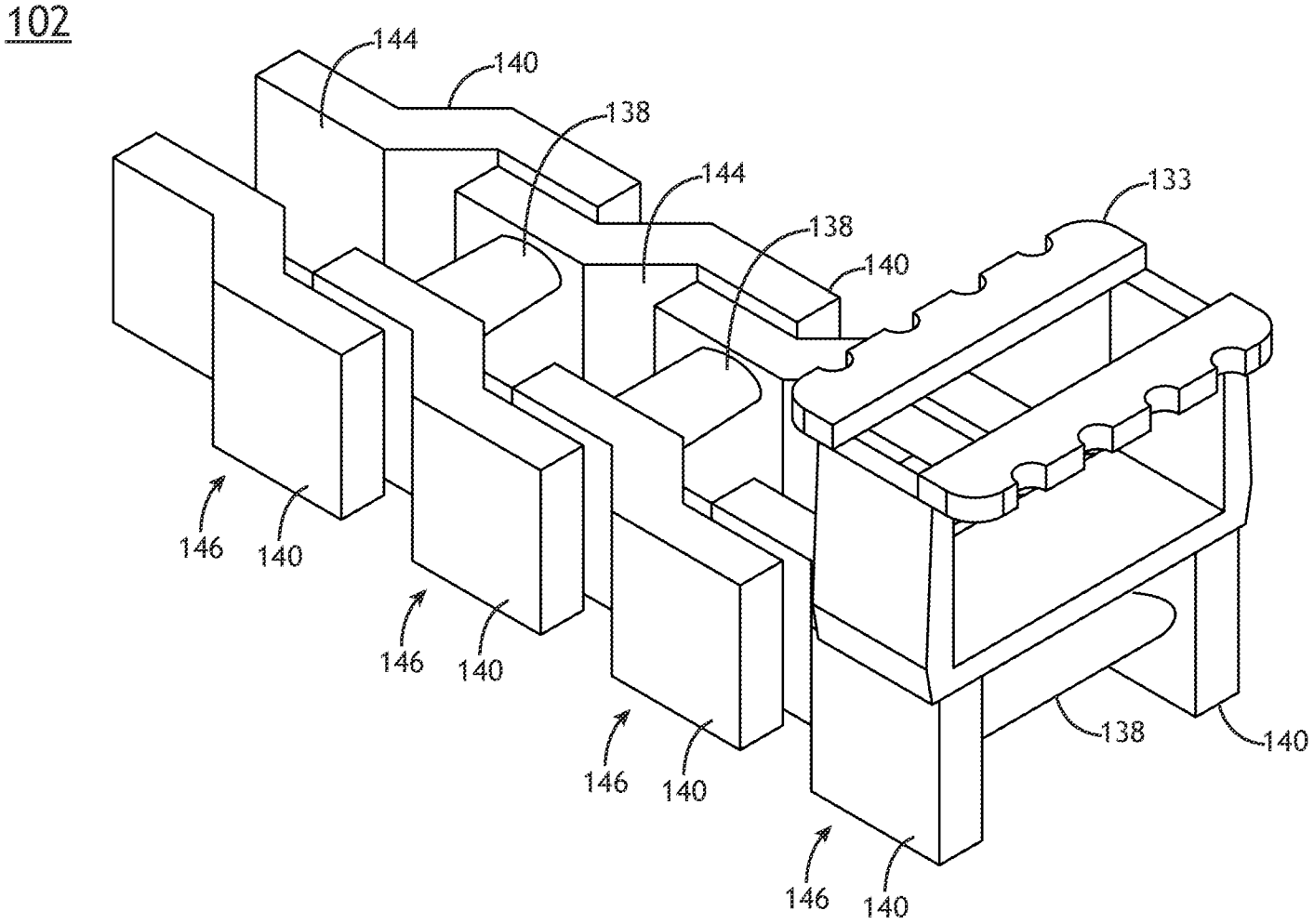
FIG. 1N depicts partial perspective view of a chain, in accordance with one or more embodiments of the present disclosure.
Figure 2A:
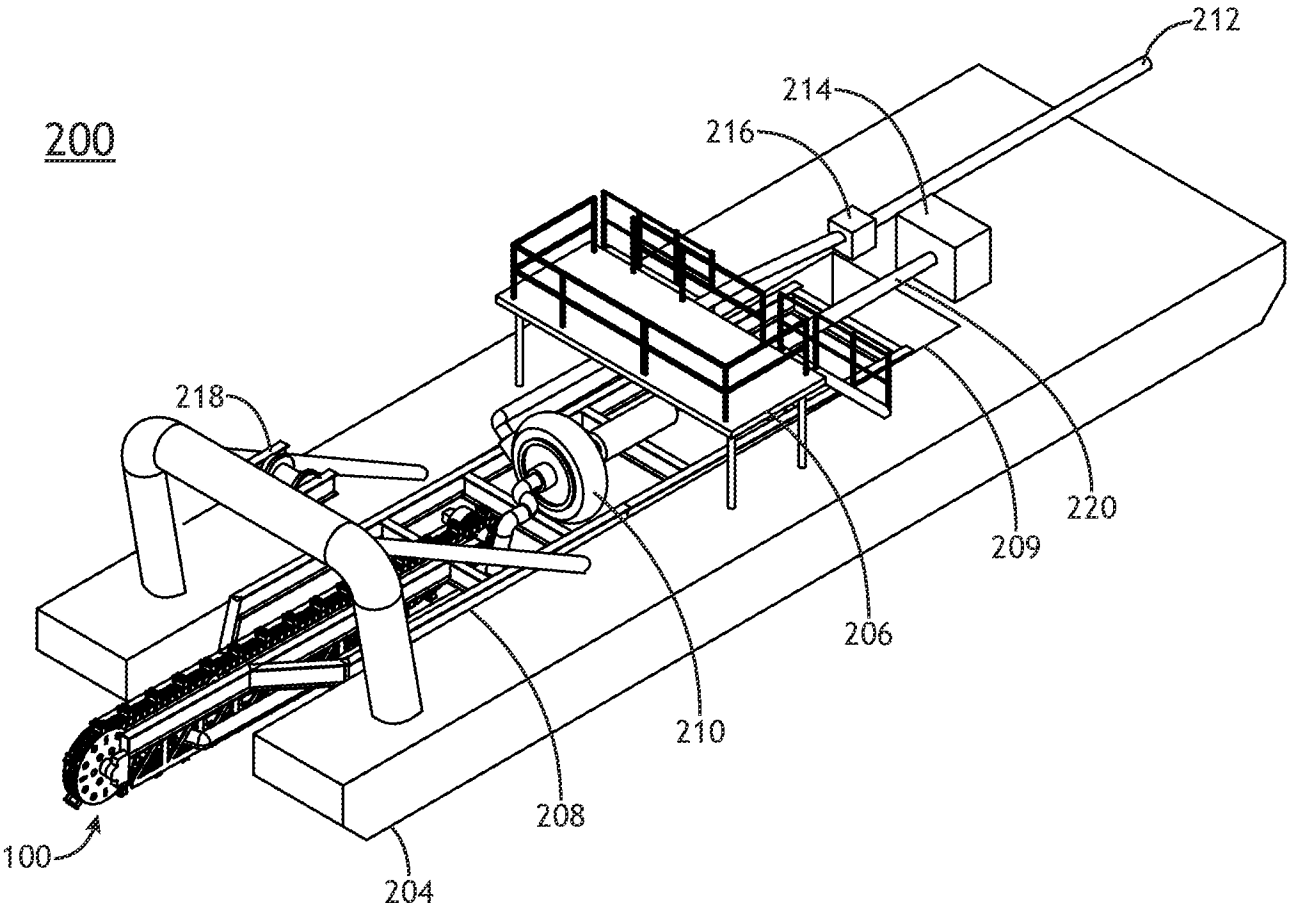
FIG. 2A depicts a perspective view of a dredging system with a dredging unit in a raised position, in accordance with one or more embodiments of the present disclosure.
Figure 2B:
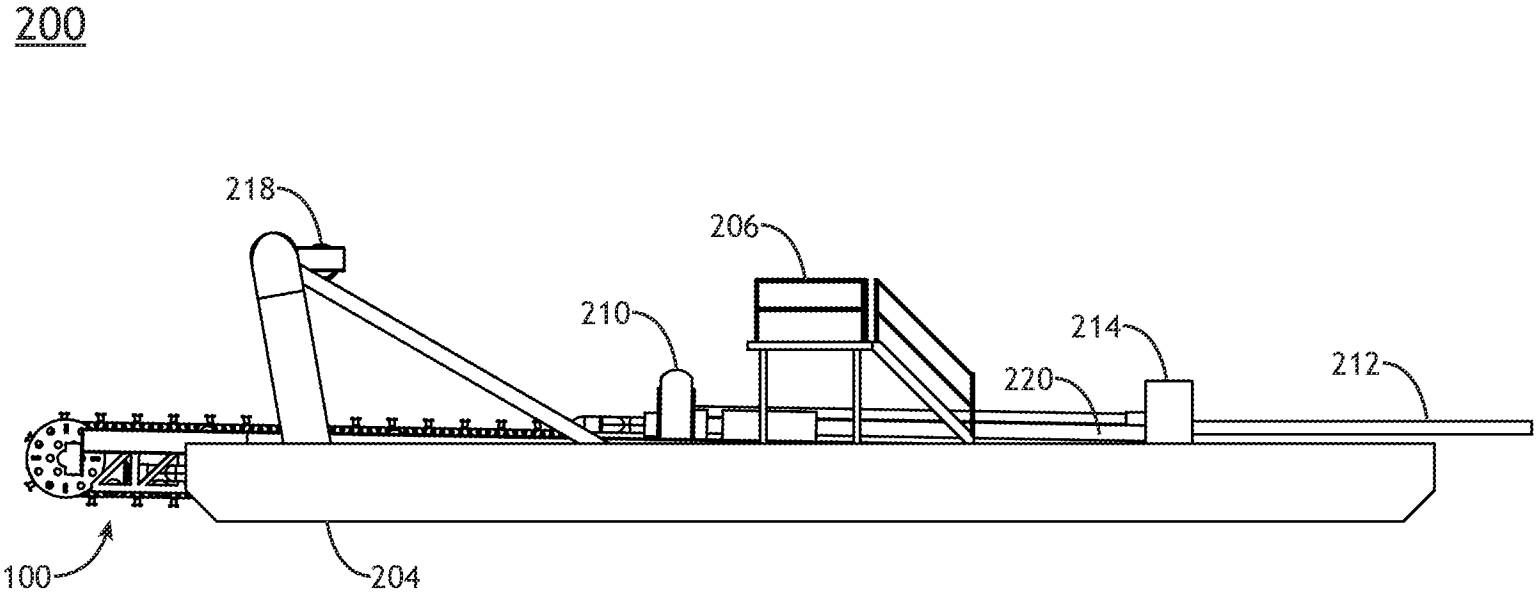
FIG. 2B depicts a side view of a dredging system with a dredging unit in a raised position, in accordance with one or more embodiments of the present disclosure.
Figure 2C:
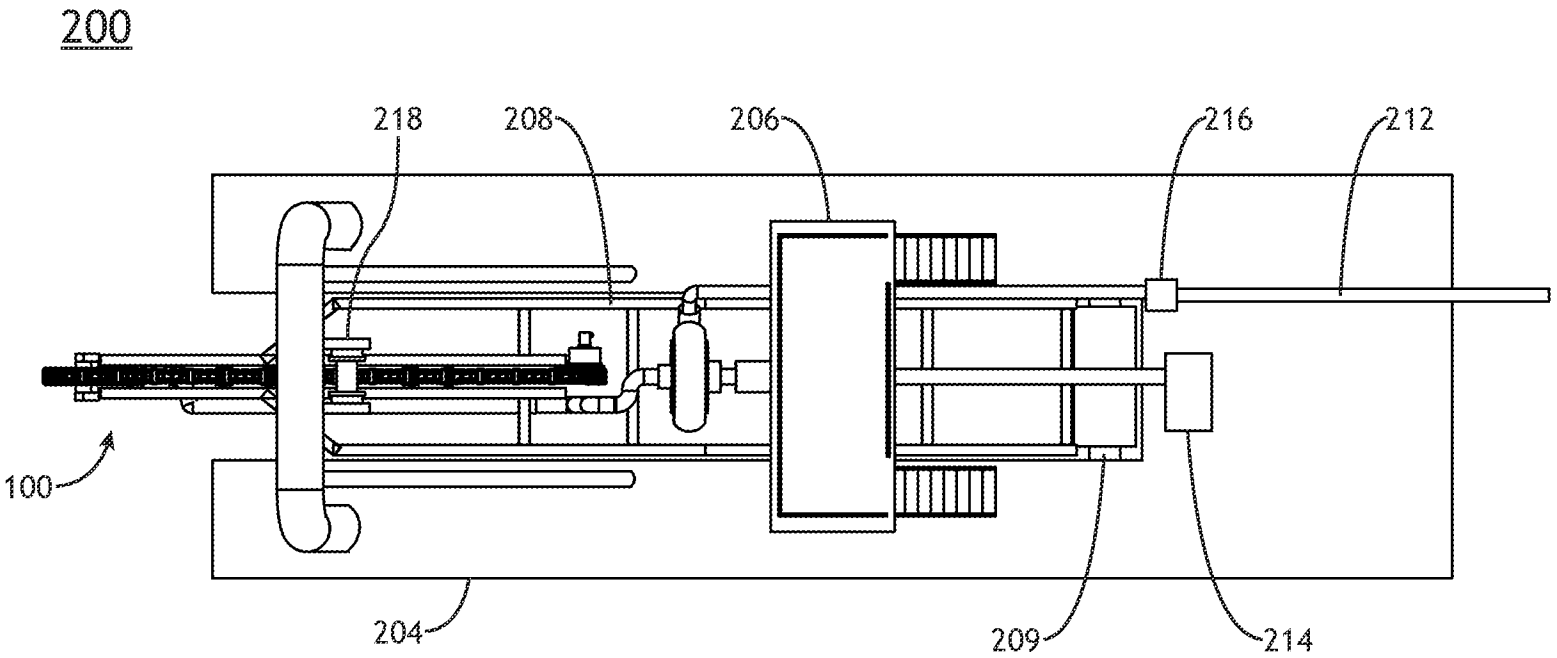
FIG. 2C depicts a top view of a dredging system with a dredging unit in a raised position, in accordance with one or more embodiments of the present disclosure.
Figure 2D:
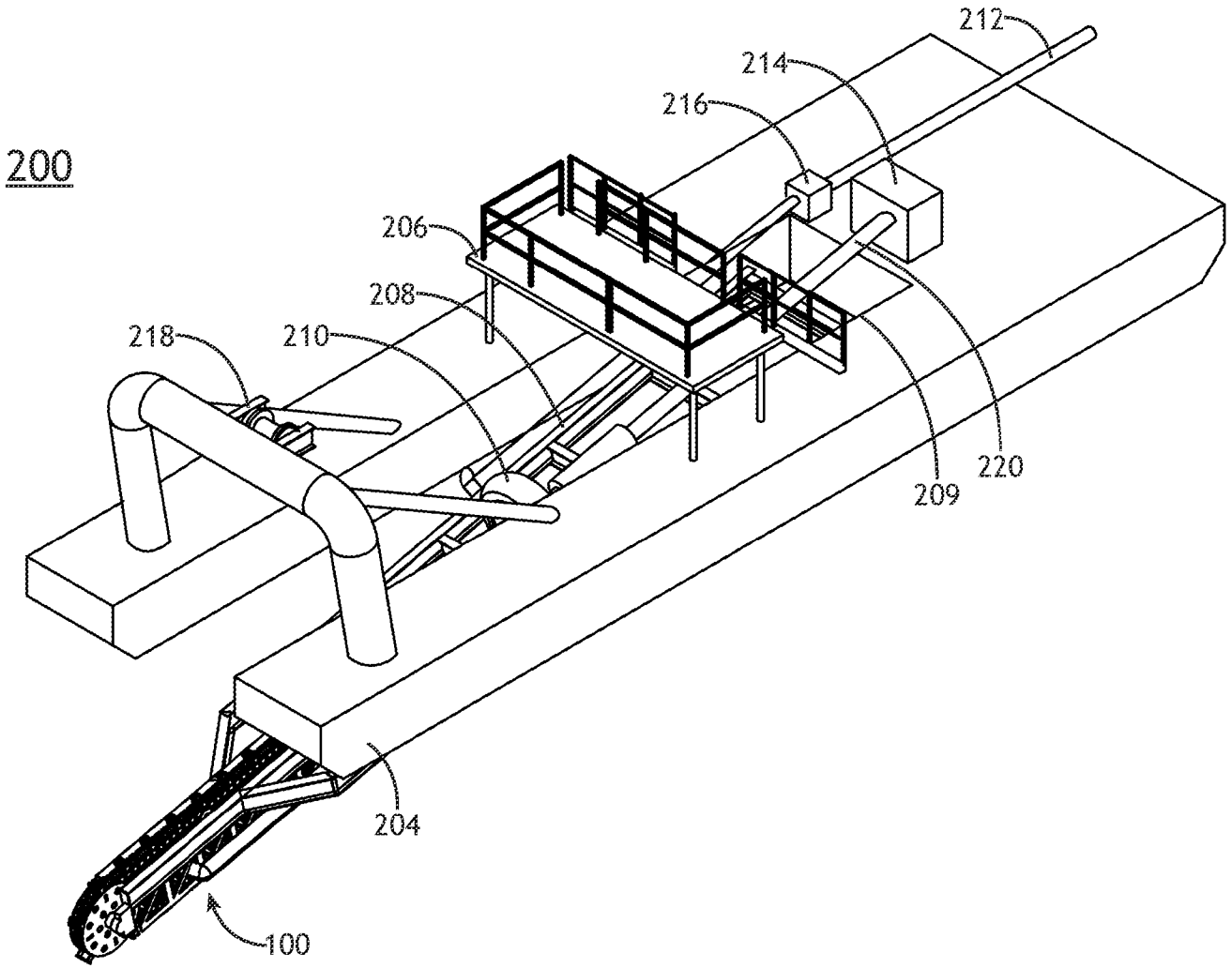
FIG. 2D depicts a side view of a dredging system with a dredging unit in a lowered position, in accordance with one or more embodiments of the present disclosure.
Figure 2E:
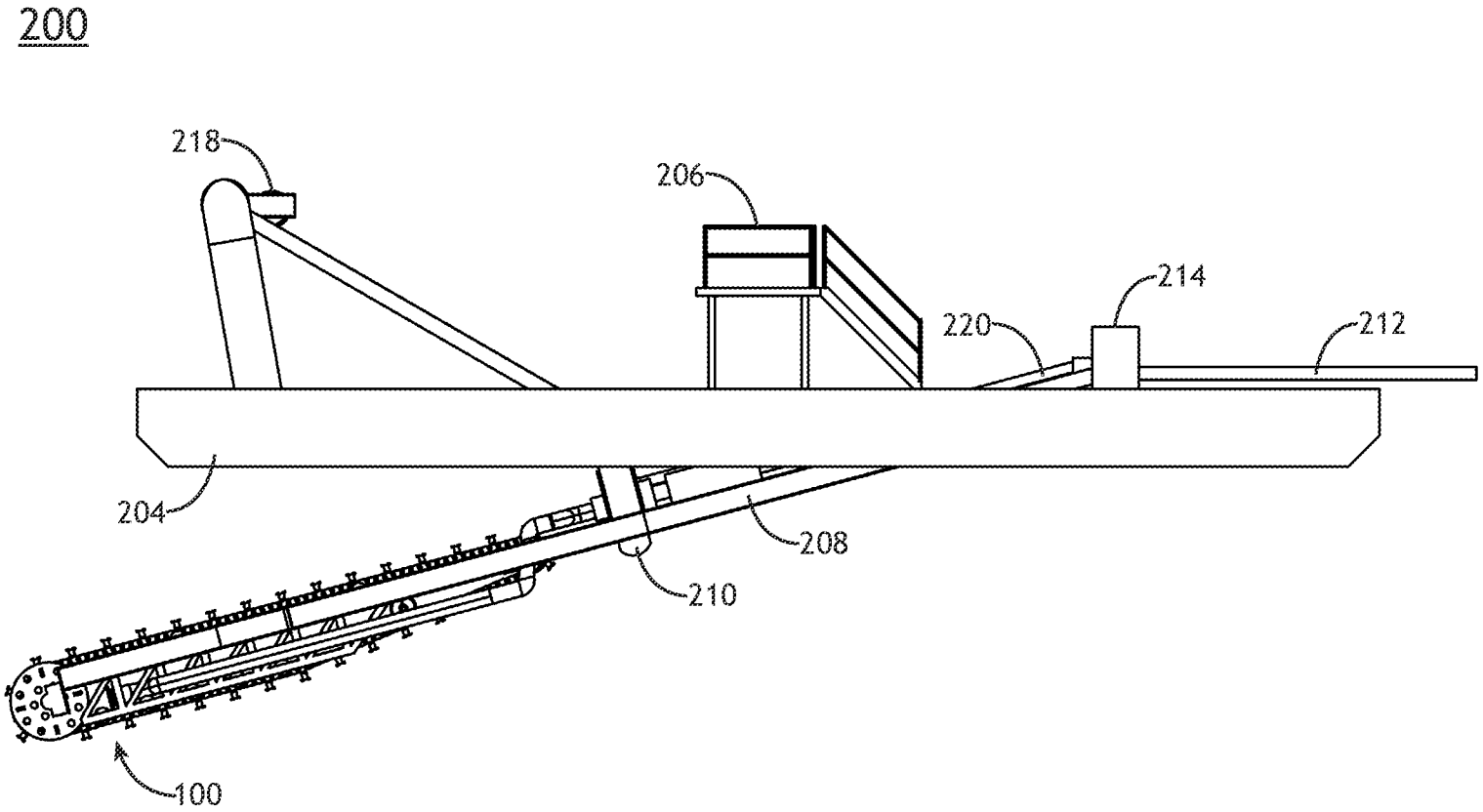
FIG. 2E depicts a side view of a dredging system with a dredging unit in a lowered position, in accordance with one or more embodiments of the present disclosure.

Referring now to FIGS. 1A-1N, a dredging unit 100 is described, in accordance with one or more embodiments of the present disclosure. The dredging unit 100 may also be referred to as a chain driven excavation wheel, a dredging implement, a single chain, single wheel, chain-driven, cutter wheel excavator for hydraulic dredging, and the like. The dredging unit 100 may hydraulically dredge material which is in a mixture with water (e.g., slurry). The dredging unit 100 may loosen and/or excavate the material. The dredging unit 100 may also prevent oversize material from being suctioned. The dredging unit 100 may include one or more components, such as, but not limited to, a chain 102, excavation wheel 104, beams 106, rollers 110, drive 112, trusses 114, shaft support 116, suction pipe 124, and the like.

The dredging unit 100 includes the pair of beams 106. The pair of beams may be aligned. The pair of beams 106 may include a first end and a second end. The beams 106 may include any suitable shape of beam. For example, the beams 106 are depicted as I-beams, although this is not intended as a limitation of the present disclosure.

The dredging unit 100 includes the drive 112. The drive 112 may be coupled to an end of the beams 106. For example, the drive 112 may be coupled the beams 106 by an adapter plate or the like. The drive 112 may include one or more components, such as, but not limited to, a sprocket 128, motor 130, and gearbox 132.

The drive 112 may include sprocket 128. The drive 112 may be configured to rotate the sprocket about an axis. The sprocket 128 may include any number of teeth.

The drive 112 may include motor 130. The motor 130 may be powered by any suitable source. In some embodiments, the motor 130 may be a hydraulic motor (e.g., a hydraulic rotary actuator). For example, the hydraulic motor may receive a flow of hydraulic fluid under pressure from a hydraulic pump. The hydraulic drive may then rotate the sprocket 128 in response to the flow of the hydraulic fluid. It is further contemplated that the motor 130 may be a mechanical motor, an electric motor, and the like. The mechanical and/or hydraulic motor may be advantageous given that the dredging unit 100 is disposed underwater. In this regard, electric-type motor may be unsuitable for the dredging unit 100.

The drive 112 may include gearbox 132. The gearbox 132 may be coupled between the motor 130 and the sprocket 128. The gearbox 132 may include one or more gears which are driven by the motor 130. The gearbox 132 may be a reduction gearbox which may reduce the speed of the input from the motor 130 and increase the torque of the input. The gearbox 132 may then increase the torque of the sprocket 128. Increasing the torque of the sprocket 128 may be desirable to enable the sprocket 128 to drive the chain 102 and the excavation wheel 104. In some embodiments, the gearbox may be a planetary gearbox.

The dredging unit 100 includes the chain 102. The chain 102 may also be referred to as an endless chain. The chain 102 may include any type of chain, such as, but not limited to, a roller chain, a bar-link chain, and the like. In some embodiments, the chain 102 may include links 146. The chain 102 may include any number of the links. The number and dimensions of the links 146 controls the length of the chain 102. The chain 102 may include a series of links 146 coupled together in series to form an endless. The links 146 may include rollers 138 and plates 140. Each of the links 146 may include one of the rollers 138 and a pair of the plates 140. The rollers 138 may be disposed between the plates 140. The rollers 138 may include a diameter. The diameter of the rollers 138 may be received by one or more sprockets.

In some embodiments, the chain 102 defines openings 144. The openings 144 are defined between adjacent of the links 146 in the chain 102. The openings 144 may be defined between the rollers 138 and the side plates 140 of the links of the chain 102. Each of the adjacent links may define one of the openings 144. In this regard, the chain 102 may define multiple of the openings 144. The length of the plates 140 and/or the diameter of the rollers 138 may control the dimensions of the openings 144. The dimensions of the links 146 may be selected to prevent oversize material from entering between the beams 106. Preventing the oversize material from entering between the beams 106 further prevents the oversize material from being suctioned by the suction pipe 124.

The chain 102 may be coupled between the drive 112 and the excavation wheel 104. The chain 102 may travel between the beams 106. In some embodiments, the chain 102 may be rotated endlessly. In this regard, the chain 102 may transmit a mechanical drive from the drive 112 to the excavation wheel 104. The chain 102 may be configured to engage with one or more sprockets for transmitting the mechanical drive. For example, the chain 102 may be coupled to a sprocket 120 of the excavation wheel 104 and/or a sprocket 128 of the drive 112. The sprocket 128 may couple the drive 112 to the chain 102. The drive 112 may drive the chain 102. The chain 102 may then continue to the excavation wheel 104, such that the drive 112 may drive the excavation wheel 104 via the chain 102. The driving power for the excavation wheel 104 is from the drive 112 by way of the chain 102. In some embodiments, the chain 102 may be considered in an open belt/chain configuration between the drive 112 and the excavation wheel 104.

In some embodiments, the chain 102 may include one or more extractor elements 133. The extractor elements 133 may be considered digging elements on an endless chain. The extractor elements 133 work in the direction of travel of the chain 102. The extractor elements 133 are coupled to the links 146. The extractor elements 133 may extend outwards from the chain 102. Extending outward from the chain 102 may refer to the extractor elements 133 having a height which is greater than the rollers 138 and/or the plates 140. The extractor elements 133 may be arranged at one or more positions along the chain 102. The extractor elements 133 may be coupled in the chain 102 by one or more of the links 146. The extractor elements 133 may at any interval on the chain 102. For example, the chain 102 is depicted as including the extractor elements 133 at every fourth link, although this is not intended as a limitation of the present disclosure. Additional of the extractor elements 133 may be added in the chain 102 to decrease the spacing between the extractor elements 133.

The extractor elements 133 may follow the rotation of the chain 102. The rotation of the chain 102 may cause the extractor elements 133 to remove oversize material from the excavation zone (i.e., from the area surrounding the excavation wheel 104). In some instances, the material may be conveyed up to and discarded behind the drive 112, although this is not intended to be limiting. The number of the extractor elements 133 and/or the spacing between the extractor elements 133 may control the amount of material conveyed away from the excavation area. Increasing the number of the extractor elements 133 may increase the amount of material conveyed away from the excavation area. The rotation of the chain 102 may cause oversize material to be moved away from the excavation wheel 104. In embodiments, the chain 102 may be used as a moving screen in front of the suction pipe 124. Thus, the chain 102 may drive the excavation wheel 104 and may also prevent oversize material from entering between the beams 106.

The dredging unit 100 includes the excavation wheel 104. The excavation wheel 104 may also be referred to as an excavator wheel, a cutting wheel, a rotary cutter head, or the like. The excavation wheel 104 may be considered a chain-driven excavation wheel 104 by the chain 102. The excavation wheel 104 may be coupled to an end of the beams 106. In this regard, the excavation wheel 104 is disposed on the dredging unit 100 at an opposite end to the drive 112. The excavation wheel 104 is turned around an axis by the chain 102. The excavation wheel 104 may include one or more components, such as, but not limited to, side plates 118, sprocket 120, shaft 121, and the like. Each of the components of the excavation wheel 104 may follow the rotation of the excavation wheel 104.

The excavation wheel 104 includes a pair of side plates 118. The side plates 118 may include a circular shape. For example, the side plates may be formed of a sheet of material and cut into the circular shape. The side plates 118 may define openings 122. The openings 122 may include circular openings. The circular openings may include a diameter. It is further contemplated that the openings 122 may include any suitable shape of opening. In some embodiments, the openings 122 may be arranged in a pattern on the side plates 118. For example, the openings 122 may be arranged at 30-degree intervals around the outer perimeter of the side plates 118. By way of another example, the openings 122 may be arranged around an inner perimeter adjacent to the shaft 121 of the excavation wheel 104.

The excavation wheel 104 includes shaft 121. The excavation wheel 104 may turn or rotate about the shaft 121. The shaft 121 of the excavation wheel 104 may include a bearing. In embodiments, the bearing may include bearings which are suitable for marine applications. The bearing may also be referred to as marine bearings. The side plates 118 may receive the shaft 121 of the excavation wheel 104 through a central hole of the side plates 118. The side plates 118 may be fixed to the shaft 121, such that the side plates 118 may rotate with the shaft 121. For example, the side plates 118 may be fixed to the shaft 121 by a joint (e.g., a weld, a setscrew, etc.).

The excavation wheel 104 includes the sprocket 120. The sprocket 120 may also be referred to as sprocket-type engagement teeth. The sprocket 120 may be disposed between and coupled to the side plates 118. The sprocket 120 may include any number of teeth. For example, the sprocket 120 is depicted as a four-tooth sprocket coupled between the pair of side plates 118, although this is not intended to be limiting. The sprocket 120 may be configured to receive the chain 102. The sprocket 120 may receive the chain 102 via the rollers 138. The chain 102 may engage the sprocket 120. Movement of the chain 102 may cause the sprocket 120 to rotate the excavation wheel 104. The chain 102 may engage the sprocket 120 at an interface 136. The interface 136 between the chain 102 and the sprocket 120 may include several of the links 146 of the chain 102 engaging with one or more teeth of the sprocket 120. For example, the interface 136 may be at a front portion of the chain 102 and/or the excavation wheel 104. Thus, the chain 102 causes the excavation wheel 104 to rotate. The excavation wheel 104 may rotate in the same direction as the chain 102 and the drive 112.

In some embodiments, the dredging unit 100 defines openings 142. The openings 142 may be adjacent to the chain 102 at the interface 136. The openings 142 adjacent to the chain 102 at the interface 136 may be defined between the side plates 118 and the plates 140. In this regard, the chain 102 may define the openings 142 on each side of the chain 102. In embodiments, the width of the chain 102 and/or the width between the side plates 118 of the excavation wheel 104 may be selected to control the spacing of the openings 142.

In some embodiments, the excavation wheel 104 may rotate for loosening and excavating material. The excavation wheel 104 may include a profile which is able to excavate in all directions. The dredging unit 100 may include an excavation profile based on the width between the side plates 118. In embodiments, the excavation profile of the dredging unit 100 is more than three times the width of the chain 102.

In some embodiments, the material may pass through the excavation wheel 104 and be disposed between the beams 106. The material may pass through one or more openings 122 of the side plates 118, through the chain 102 (i.e., through the openings 144), between the chain 102 and the side plates 118 (i.e., through the openings 142), and the like. The excavation wheel 104 excavate in the direction of rotation of the excavation wheel 104 by allowing the material to pass through the through the chain 102 and to pass between the chain 102 and the side plates 118. The excavation wheel 104 can also excavate in the direction orthogonal to the direction of rotation of the excavation wheel 104 by the openings 122 of the side plates 118. By excavating in both the direction of rotation and the direction orthogonal to the direction of rotation, the excavation wheel 104 can excavate in all directions. Excavating in all direction is beneficial to eliminate a slot-type dredging.

In some embodiments, the chain 102 and the excavation wheel 104 may screen out over size material and aggressively excavate material in all directions. For example, the openings 122 defined in the side plates 118 of the excavation wheel 104 may function as the screen. The excavation wheel 104 may thus be considered to have a non-fouling design for screening oversize material and clay. In embodiments, the material may pass through the interface 136 of the chain 102 engaged to the sprocket 120 and may pass through the openings 122. For example, the material may pass through the openings 144 defined between the rollers 138 and/or plates 140. By way of another example, the material may pass through the openings 142 adjacent to the chain 102 defined by the side plates 118 and the plates 140. Thus, the material may pass through the interface 136 (e.g., the openings 142, the openings 144) and/or through the side plates 118 (e.g., the openings 122). The excavation wheel 104 and chain 102 may be considered strainers for preventing the entry of stones or oversize material to the suction inlet 126. The excavation wheel 104 and chain 102 are advantageous as the strainers because the excavation wheel 104 and chain 102 are in motion. The excavation wheel 104 and chain 102 may then be prevented from clogging with the oversize material when the suction inlet 126 provides the suction force. The dredging unit 100 does not require a strainer at the mouth of the suction inlet 126 due to motion of the excavation wheel 104 and chain 102. Strainers located at the mouth of the suction inlet 126 undesirably are stationary and may be clogged with the oversize until the suction force is released.

The dredging unit 100 includes the suction pipe 124. The suction pipe 124 includes a suction inlet 126. The suction inlet 126 may provide an inlet for the material to the suction pipe 124. The suction inlet 126 may also be referred to as a suction bell. The suction inlet 126 may be disposed between the beams 106. The suction inlet 126 is disposed between the pair of beams 106 at the end of the pair of beams 106 at which the excavation wheel 104 is coupled. The suction inlet 126 may be disposed proximate to the excavation wheel 104. In some embodiments, the suction inlet 126 may be disposed between the side plates 118 of the excavation wheel 104. The suction inlet 126 acts by a sucking or forcing effect. In this regard, the suction pipe 124 may incorporate the suction into and/or behind the excavation wheel 104. The excavation wheel 104 may then allow the suction inlet 126 to suction in slurry from multiple directions. For example, the suction inlet 126 may suction in the slurry from the openings 122 defined by the side plates 118 to the suction inlet 126. By way of another example, the suction inlet 126 may suction in the slurry through the chain 102 to the suction inlet 126. The suction inlet 126 may pull material from almost all directions relative to the excavation wheel 104. The interior of the dredging unit 100 between the beams 106 may provide a large open area for material to enter the suction inlet 126. The material from the suction inlet 126 may then be transported through the suction pipe 124 to be disposed of by the dredge pump 210.

The ability to suction material through the interface 136 and/or through the side plates 118 may allow the material to from the front, the sides, top, and bottom of the excavation wheel 104. The material may then be suctioned from between the beams 106. Thus, the dredging unit 100 may suction material through the excavation wheel 104 without a chain or bucket wheel drawing in material. It is contemplated that suctioning material without the chain or bucket wheel in drawing the material may be an advantage provided by the dredging unit 100.

In some embodiments, the suction inlet 126 may include a contoured shape. The contoured shape may be based on the shape of the excavation wheel 104. For example, the suction inlet 126 may include a contoured arc which matches a portion of the excavation wheel 104. The contoured arc may provide the suction inlet 126 with a cross-sectional area which covers the portion of the excavation wheel 104. The suction inlet 126 may then suction directly from the excavation wheel 104. In some embodiments, the suction inlet 126 is a fish-mouth shaped pipe.

The dredging unit 100 includes the shaft support 116. The shaft support 116 may mount the shaft 121 of the excavation wheel 104 to the beams 106. The shaft support 116 may enable the excavation wheel 104 to rotate relative to the beams 106. The shaft support 116 may be a fastening device with the ability to detach and attach the excavation wheel 104. For example, the excavation wheel 104 may be detached for performing maintenance on the excavation wheel 104 and/or on the suction inlet 126. The shaft support 116 may include, but is not limited to, a base-mounted shaft support. The base-mounted shaft support may also be referred to as a pillow block bearing or a Plummer block. The base-mounted shaft support may include two pieces which may clamped together a bearing mounted to the shaft 121 of the excavation wheel 104.

The dredging unit 100 includes rollers 110. The rollers 110 may function as an idler for the chain 102. The rollers 110 may be coupled between the beams 106. The rollers 110 may interface between the beams 106 and the chain 102, thereby supporting the chain 102. The rollers 110 support the chain 102 between the ends of the pair of beams 106. The rollers 110 may reduce a loss of energy in the chain 102 due to drag. The rollers 110 may also be referred to as roller units, rolling elements, idlers, or roller bearings. The rollers 110 may include bearings which are suitable for marine applications. The rollers 110 may also be referred to as marine bearings. In embodiments, the rollers 110 may function as a track for the chain. For example, the rollers 110 may include sidewalls. The sidewalls of the rollers 110 may prevent the chain 102 from slipping off the dredging unit 100. In this regard, the rollers 110 may be considered a double-flanged track roller.

In some embodiments, the rollers 110 may include a first set of rollers 110*a*. The first set of rollers 110*a* may provide an upper set of idlers for the chain 102. The first set of rollers 110*a* may be coupled to the beams 106.

In some embodiments, the rollers 110 may include a second set of rollers 110*b*. The second set of rollers 110*b* may provide a lower set of idlers for the chain 102. The second set of rollers 110*b* may be coupled between the trusses 114. The trusses 114 may each be coupled to one of the beams 106. The trusses 114 may then extend from a side of the beams 106. The trusses 114 may also be coupled to the second set of rollers 110*b*. In this regard, the trusses 114 may be used to extend the location of the second set of rollers 110*b* from the side of the beams 106.

Although the dredging unit 100 is described as including the rollers 110, this is not intended as a limitation of the present disclosure. In embodiments, the dredging unit 100 may include a chain guide. It is further contemplated that the dredging unit 100 may include the rollers 110 and/or the chain guide. The chain 102 may drag or roll across a surface of the chain guide. In this regard, the chain guide may guide the chain 102 and prevent the chain 102 from falling off the dredging unit 100. The chain guide may include any type of chain guide, such as, but not limited to ANSI type-T, ANSI type-U, ANSI type-TS, and the like. In some embodiments, the chain guide is a center-channel chain guide. The chain guide may include the functionality of either of the first set of rollers 110*a* and/or the second set of rollers 110*b*. In this regard, the dredging unit 100 may include a top chain guide and/or a bottom chain guide. In some embodiments, the chain 102 may include rollers on one or more of the links 146.

In some embodiments, the dredging unit 100 includes a chain tensioner 108. In embodiments, the chain tensioner 108 may be coupled to the beams 106. The chain tensioner 108 may also be referred to as a tension idler. The chain tensioner 108 may tension the chain 102. Tensioning the chain 102 eliminates slack in the chain 102. For example, the chain tensioner 108 may tension an angled portion of the chain 102 disposed between the trusses 114 and the drive 112. The chain tensioner 108 may be a spring-operated chain tensioner and/or a hydraulically-operated chain tensioner. The chain tensioner 108 may tension the chain 102 outward from the beams 106. Tensioning the chain 102 may be advantageous for keeping the chain on the first set of rollers 110*a* and/or on the chain guide.

Referring now to FIGS. 2A-2E, a dredging system 200 is described, in accordance with one or more embodiments of the present disclosure. The dredging system 200 may also be referred to as a dredge ship, floating dredge, chain ladder dredge, and the like. The dredging system 200 may include one or more components, such as, but not limited to, the dredging unit 100, barge 204, platform 206, ladder 208, dredge pump 210, discharge pipe 212, power source 214, auxiliary pump 216, winch 218, drive shaft 220, and the like.

The dredging system 200 includes the dredging unit 100. The dredging unit 100 prevents suctioning oversize material, thereby preventing the oversize material from plugging an impeller of the dredge pump 210. The dredging unit 100 may provide several advantages, such as, but not limited to, hydraulic dredging of a slurry while preventing oversize material in the slurry from being stuck in the dredge pump 210.

The dredging system 200 includes the barge 204. The barge 204 may also be referred to as floats, pontoons, or the like. The barge 204 may collectively form a hull, floating substructure, or the like. The barge 204 may be disposed around the perimeter of the dredging system 200. For example, the dredging system 200 is depicted as including the barge 204 around the port, starboard, and aft portions of the perimeter. The barge 204 may also be disposed underneath the platform 206. The dredging system 200 may be configured float on water by the barge 204. The barge 204 may displace a volume of water when the dredging system 200 is disposed in water. By the displaced volume, the dredging system 200 may be positively buoyant such that the dredging system 200 floats. The barge 204 may define one or more slots for receiving the dredging unit 100 and the ladder 208. For example, the dredging system 200 is positively buoyant in a fluid with a density of 1 gram per cubic centimeter.

The dredging system 200 includes the platform 206. The platform 206 may be centrally disposed on the dredging system 200. The platform 206 may provide a level surface on which an operator may stand when operating the dredging system 200. The platform 206 may include controls to operate the dredging unit 100, the ladder 208, the dredge pump 210, and the like. In some embodiments, the platform 206 includes an enclosed cabin (not depicted) to shield the operator from weather.

The dredging system 200 includes the ladder 208. The ladder 208 may also be referred to as a boom. The ladder 208 may include a framework of one or more beams. For example, the ladder 208 includes a framework of I-beams or the like. The dredging unit 100 is coupled to the ladder 208. The ladder 208 is pivotably mounted 209 to the barge 204. In some embodiments, the dredging unit 100 is coupled to a first end of the ladder 208 and the second end of the ladder 208 is pivotably mounted 209 to the barge 204. The ladder 208 may be configured to pivot between a wide range of angles to achieve the desired position for the dredging unit 100. Thus, the dredging unit 100 is pivotable relative to the barge 204. For example, the dredging unit 100 may be pivoted to a raised position. The dredging unit 100 may be generally parallel with the barge 204 in the raised position. The raised position may be beneficial to prevent from catching the dredging unit 100 on material underwater. By way of another example, the dredging unit 100 may be pivoted to a lowered position. The dredging unit 100 may be at an acute angle to the barge 204 in the lowered position. The lowered position may be beneficial to control a depth at which the dredging unit 100 suctions the material.

The dredging system 200 may include the winch 218. The winch 218 is mounted to the barge 204 above the dredging unit 100. The winch 218 may be coupled to one of the dredging unit 100 or the ladder 208. For example, the winch 218 may be coupled to the dredging unit 100 or the ladder 208 by a chain, a pully, and the like. The winch 218 may be controlled to raise and lower the dredging unit 100 and the ladder 208. For example, the winch 218 may cause the dredging unit 100 and the ladder 208 to rotate about the pivotably mount 209. The ladder 208 and winch 218 may be used to direct the dredging unit 100 to the material to be dredged.

The dredging system 200 includes dredge pump 210. The dredge pump 210 may include a pump, impeller, and the like. The dredge pump 210 may be fluidically coupled to the suction pipe 124 and/or the suction inlet 126. The dredge pump 210 may be coupled to the suction inlet 126 by one or more pipes. The suction pipe 124 may be coupled to the dredge pump 210. In this regard, the dredge pump 210 may cause the suction pipe 124 to incorporate suction into the dredging unit 100. The dredge pump 210 may suction material from the suction inlet 126. In some embodiments, the dredge pump 210 is coupled to the ladder 208. In this regard, the dredge pump 210 may be considered an underwater pump.

The dredging system 200 may include the discharge pipe 212. The discharge pipe 212 is fluidically coupled to the dredge pump 210. The dredge pump 210 may transport material to the discharge pipe 212, for discharging the material from the dredging system 200. The discharge pipe 212 may extend from a rear of the barge 204. The discharge pipe 212 may extend to one or more additional pipes (not depicted). For example, the discharge pipe 212 may extend to a shoreline or the like. The material may then be transported from the dredging system 200 to the shoreline.

In some embodiments, the dredging system 200 may include the auxiliary pump 216. The auxiliary pump 216 may be coupled to the barge 204. The auxiliary pump 216 may then be considered an on-hull pump. The discharge pipe 212 is fluidically coupled to the dredge pump 210 via the auxiliary pump 216. The auxiliary pump 216 may be beneficial to increase a pressure in the discharge pipe 212. For example, the dredge pump 210 may lose pressure over the length of the discharge pipe 212. It is further contemplated that the ladder 208 may be used with any suitable configuration of pumps, such as, but not limited to, on-deck pumps, hull pumps, underwater pumps, and the like.

The dredging system 200 may include the power source 214. The power source 214 may power any of the various components of the dredging system 200. For example, the power source 214 may power the drive 112, dredge pump 210, auxiliary pump 216, winch 218, and the like. The power source 214 may include any suitable power source, such as, but not limited to, electric, diesel, gasoline, natural gas, and the like.

in some embodiments, the dredging system 200 includes a drive shaft 220. The power source 214 is coupled to the dredge pump 210 by the drive shaft 220. In this regard, the drive shaft 220 may rotate the impeller of the dredge pump 210, for powering the dredge pump 210.

In some embodiments, the dredging system 200 is self-propelled. For example, the dredging system 200 may include one or more propellers (not depicted) or the like. The propellers may receive power from the power source 214.

Referring generally again to FIGS. 1A-2E. The various dimensions depicted in the figures are not intended to be limiting. It is contemplated that modifications may be made to the dimensions while remaining within the scope of the present disclosure.

As used herein, material may refer to any bulk material common in dredging, such as, but not limited to, mud, silt, sand, soil, dirt, clay, gravel, and the like. The material may be suspended in a mixture of water. The mixture of water and the material may also be referred to as a slurry.

Any of the various components described may include any environmentally resistant material suitable for use in marine applications, such as, but not limited to a nickel-plated material, a stainless-steel material, an aluminum material, a plastic material, and the like.

In embodiments, the chain 102 does not include a bucket. Thus, the dredging unit 100 may not be considered a bucket-wheel type dredging unit. Not including the bucket on the chain 102 may be advantageous. For example, the chain 102 may not become clogged because the chain does not include the buckets. The buckets may become clogged with material if the chain 102 includes the buckets.

Although the dredging unit 100 is described as including the beams 106 and the trusses 114, this is not intended as a limitation of the present disclosure. It is contemplated that the dredging unit 100 may include one or more of the following for providing structural support: a truss, a beam (e.g., an I-beam), a combination of truss and beam, a pipe, a tube, and the like. Thus, the structure of the dredging unit 100 may include a beam-only structure, a truss-only, or a beam and truss structure.

Although the dredging unit 100 is described as used with the dredging system 200 in the context of dredging ships, this is not intended as a limitation of the present disclosure. It is contemplated that the dredging unit 100 may be used with other machines. In some embodiments, the dredging unit 100 may be used to tracked vehicle dredgers. For example, the dredging unit 100 may be used as an implement for a backhoe or the like.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A dredging unit comprising:

a pair of beams;

a drive coupled to a first end of the pair of beams, the drive comprising a motor and a first sprocket, wherein the motor is configured to rotate the first sprocket;

an excavation wheel rotatably coupled to a second end of the pair of beams, the excavation wheel comprising:
a pair of side plates, wherein the pair of side plates each define a plurality of openings; and
a second sprocket disposed between and coupled to the pair of side plates;
a chain coupled to the first sprocket and the second sprocket, wherein rotation of the first sprocket causes the chain to rotate causing the second sprocket to rotate the excavation wheel; and
a suction pipe comprising a suction inlet, wherein the suction inlet is disposed between the pair of beams at the second end of the pair of beams, wherein the suction inlet is configured to suction a slurry through the plurality of openings defined by each of the pair of side plates and suction the slurry through an interface between the chain and the excavation wheel.

2. The dredging unit of claim 1, wherein the excavation wheel and the chain are configured to strain the slurry with rotation of the excavation wheel and the chain.

3. The dredging unit of claim 1, the drive comprising a gearbox; wherein the gearbox is coupled between the motor and the first sprocket, wherein the motor is configured to rotate the first sprocket via the gearbox.

4. The dredging unit of claim 3, wherein the motor is a hydraulic motor.

5. The dredging unit of claim 3, wherein the gearbox is a reduction gearbox.

6. The dredging unit of claim 1, wherein the chain comprises a plurality of links and a plurality of extractor elements; wherein the plurality of extractor elements are coupled to the plurality of links, wherein a bottom of the plurality of extractor elements is open, wherein the suction inlet is configured to suction the slurry from the plurality of extractor elements.

7. The dredging unit of claim 1, comprising a pair of shaft supports coupled to the pair of beams; wherein the excavation wheel comprises a shaft coupled to the pair of side plates and to the pair of shaft supports.

8. The dredging unit of claim 1, comprising a plurality of rollers, wherein the plurality of rollers support the chain between the first end and the second end of the pair of beams.

9. The dredging unit of claim 8, wherein a first set of the plurality of rollers are coupled between the pair of beams.

10. The dredging unit of claim 9, comprising a pair of trusses, wherein the pair of trusses are coupled to the pair of beams; wherein a second set of the plurality of rollers are coupled between the pair of trusses.

11. The dredging unit of claim 1, comprising an idler coupled to the pair of beams, wherein the idler tensions the chain, wherein the idler is one of a spring-operated chain tensioner or a hydraulically-operated chain tensioner.

12. The dredging unit of claim 1, wherein the plurality of openings comprises a plurality of circular openings.

13. The dredging unit of claim 12, wherein the pair of side plates are circular plates; wherein the plurality of circular openings are arranged in a pattern on the pair of side plates, wherein a first set of the plurality of circular openings are radially aligned with the second sprocket, wherein a second set of the plurality of circular openings are disposed radially inwards of the second sprocket.

14. A dredging system, comprising:
a barge;
a ladder pivotably mounted to the barge;
a dredge pump; and
a dredging unit coupled to the ladder, the dredging unit comprising:
a pair of beams;
a drive coupled to a first end of the pair of beams, the drive comprising a motor and a first sprocket, wherein the motor is configured to rotate the first sprocket;
an excavation wheel rotatably coupled to a second end of the pair of beams, the excavation wheel comprising:
a pair of side plates, wherein the pair of side plates each define a plurality of openings; and
a second sprocket disposed between and coupled to the pair of side plates;
a chain coupled to the first sprocket and the second sprocket, wherein rotation of the first sprocket causes the chain to rotate causing the second sprocket to rotate the excavation wheel; and
a suction pipe comprising a suction inlet, wherein the suction inlet is disposed between the pair of beams at the second end of the pair of beams, wherein the dredge pump is fluidically coupled to the suction pipe, wherein the suction inlet is configured to suction a slurry through the plurality of openings defined by each of the pair of side plates and suction the slurry through an interface between the chain and the excavation wheel.

15. The dredging system of claim 14, wherein the dredge pump is coupled to the ladder.

16. The dredging system of claim 14, comprising a power source and a drive shaft; wherein the power source is coupled to the barge; wherein the power source is coupled to the dredge pump by the drive shaft.

17. The dredging system of claim 14, wherein the dredge pump is coupled to the barge.

18. The dredging system of claim 14, wherein the barge defines a slot receiving the dredging unit and the ladder.

19. The dredging system of claim 14, wherein the dredging system is positively buoyant in a fluid with a density of 1 gram per cubic centimeter.

20. The dredging system of claim 14, comprising a winch mounted to the barge above the dredging unit; wherein the winch is coupled to the at least one of the dredging unit or the ladder.

* * * * *